US011214067B2

(12) United States Patent
Nishimura

(10) Patent No.: US 11,214,067 B2
(45) Date of Patent: Jan. 4, 2022

(54) SERVICE MEDIA AND METHODS FOR CLEANING PRINTHEADS

(71) Applicant: Hiroshi Nishimura, West Hills, CA (US)

(72) Inventor: Hiroshi Nishimura, West Hills, CA (US)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/796,526

(22) Filed: Feb. 20, 2020

(65) Prior Publication Data

US 2021/0260877 A1 Aug. 26, 2021

(51) Int. Cl.
*B41J 2/165* (2006.01)

(52) U.S. Cl.
CPC ..... *B41J 2/16517* (2013.01)

(58) Field of Classification Search
CPC ..... B41J 2/16517
See application file for complete search history.

(56) References Cited

U.S. PATENT DOCUMENTS

| | | | |
|---|---|---|---|
| 5,239,316 | A | 8/1993 | Demarchi et al. |
| 6,074,037 | A | 6/2000 | Nakahara et al. |
| 6,742,860 | B2 | 6/2004 | Harper |
| 6,758,548 | B2 | 7/2004 | Davis et al. |
| 2008/0018677 | A1 | 1/2008 | White et al. |

*Primary Examiner* — Sharon Polk
(74) *Attorney, Agent, or Firm* — Duft & Bornsen, PC

(57) ABSTRACT

A service media and method for cleaning printheads. In one embodiment, a method of cleaning includes inserting a service media beneath one or more printheads, inflating the service media so that an absorbent material of the service media contacts a nozzle surface of the printheads, and deflating the service media.

20 Claims, 15 Drawing Sheets

SERVICE MEDIA AND METHODS FOR CLEANING PRINTHEADS

TECHNICAL FIELD

This disclosure relates to the field of maintenance operations, and more particularly, to cleaning of printheads.

BACKGROUND

Entities with substantial printing demands often use a production printer that prints on a web of print media at high-speed (e.g., one hundred pages per minute or more). A production printer typically includes a print controller that controls the overall operation of the printer, and a print engine (sometimes referred to as an "imaging engine" or as a "marking engine") that physically marks the web. The print engine has one or more printhead arrays or printhead stations, and each individual printhead includes multiple tiny nozzles (e.g., 1280 nozzles per printhead depending on resolution) that are operable to jet or discharge ink or another type of marking material. The printheads in an array are typically arranged in a line along a particular width so that printing may occur across the width of the print media. When in operation, the print media is passed underneath the printhead array(s) while the nozzles of the printheads discharge one or more marking materials at particular intervals to form pixels or marks on the print media.

In production printers and/or another type of jetting apparatus that implements a printhead, maintenance or cleaning operations may be performed to prevent clogged nozzles and maintain image quality. However, some maintenance operations may be inconvenient to perform, and may require specialized mechanisms.

SUMMARY

Provided herein are a service media and methods for cleaning printheads in a printer or the like. One embodiment comprises a method of cleaning one or more printheads. The method comprises inserting a service media beneath the printheads, inflating the service media so that an absorbent material of the service media contacts a nozzle surface of the printheads, and deflating the service media.

In another embodiment, the method further comprises purging the printheads with the service media inflated.

In another embodiment, the method further comprises repositioning the service media beneath the printheads, inflating the service media so that the absorbent material of the service media contacts the nozzle surface of the printheads, and deflating the service media.

In another embodiment, the method further comprises removing the service media from beneath the printheads.

In another embodiment, inserting the service media comprises inserting the service media in a gap between the printheads and a web of print media.

In another embodiment, inserting the service media comprises inserting the service media in a gap between the printheads and a media support member that supports a medium during printing.

In another embodiment, the service media includes an inflatable bladder, and inflating the service media comprises injecting a fluid into the inflatable bladder.

Another embodiment comprises a method of cleaning an array of printheads in a continuous-feed printer. The method comprises inserting a service media beneath the array of the printheads, and inflating the service media so that an absorbent material of the service media contacts a nozzle surface of the printheads in the array. The service media is held stationary when inflated. The method further comprises purging the printheads with the service media inflated, and deflating the service media.

In another embodiment, the method further comprises repositioning the service media beneath the printheads, inflating the service media so that the absorbent material of the service media contacts the nozzle surface of the printheads, and deflating the service media.

In another embodiment, the method further comprises removing the service media from beneath the printheads.

In another embodiment, deflating the service media comprises deflating the service media after a threshold time where the service media is held stationary when inflated.

In another embodiment, inserting the service media comprises inserting the service media in a gap between the printheads and a web of print media.

In another embodiment, the service media includes an inflatable bladder, and inflating the service media comprises injecting a fluid into the inflatable bladder.

Another embodiment comprises a cleaning apparatus for one or more printheads. The cleaning apparatus includes a service media configured for insertion beneath the printheads. The service media comprises a backing member, an absorbent material, and an inflatable bladder disposed between the backing member and the absorbent material.

In another embodiment, the service media further comprises an adhesive that adheres the absorbent material to the backing member.

In another embodiment, the absorbent material defines a contact area that is at least as large as a footprint of the printheads.

In another embodiment, the absorbent material comprises a non-woven fabric.

In another embodiment, the absorbent material comprises an absorbent coating applied to the inflatable bladder.

In another embodiment, the inflatable bladder includes a port configured to receive a fluid from a pressure source.

In another embodiment, the service media includes a plurality of inflatable bladders that are independently inflatable.

Other illustrative embodiments (e.g., methods and computer-readable media relating to the foregoing embodiments) may be described below. The features, functions, and advantages that have been discussed can be achieved independently in various embodiments or may be combined in yet other embodiments further details of which can be seen with reference to the following description and drawings.

DESCRIPTION OF THE DRAWINGS

Some embodiments of the present disclosure are now described, by way of example only, and with reference to the accompanying drawings. The same reference number represents the same element or the same type of element on all drawings.

DETAILED DESCRIPTION

The figures and the following description illustrate specific illustrative embodiments of the disclosure. It will thus be appreciated that those skilled in the art will be able to devise various arrangements that, although not explicitly described or shown herein, embody the principles of the disclosure and are included within the scope of the disclosure. Furthermore, any examples described herein are intended to aid in understanding the principles of the disclosure, and are to be construed as being without limitation to such specifically recited examples and conditions. As a result, the disclosure is not limited to the specific embodiments or examples described below, but by the claims and their equivalents.

Figure 1:
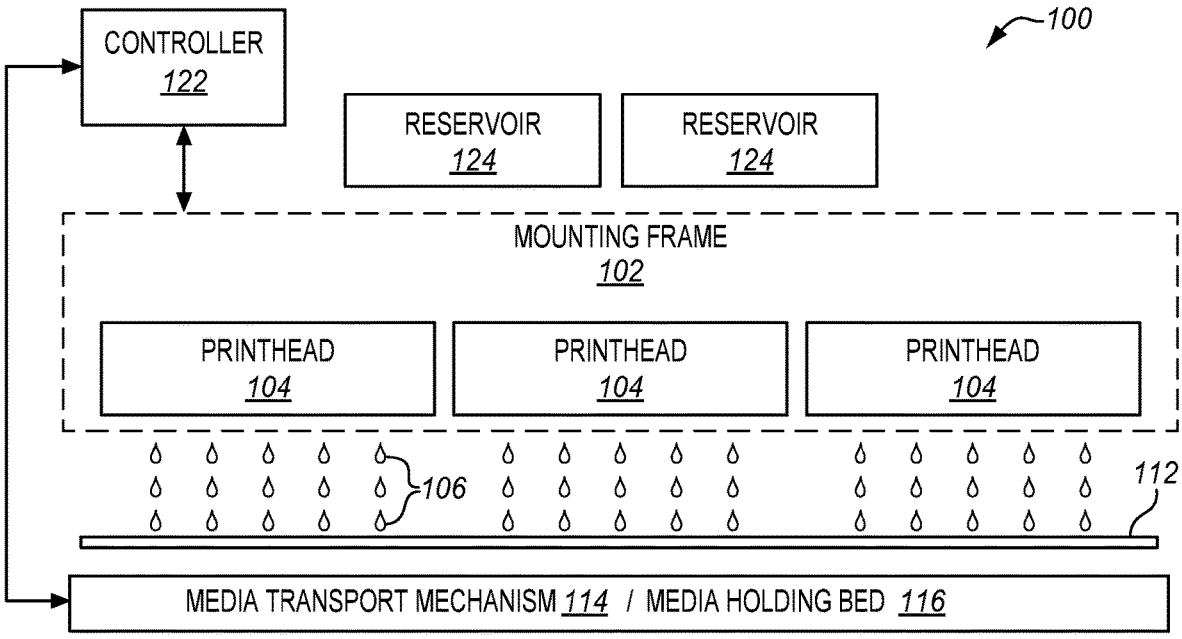
FIG. 1 is a schematic diagram of a jetting apparatus.

FIG. 1 is a schematic diagram of a jetting apparatus 100. A jetting apparatus 100 is a device or system that uses one or more printheads to eject a marking material onto a medium. One example of jetting apparatus 100 is an inkjet printer (e.g., a cut-sheet or continuous-feed printer) that performs single-pass printing. Other examples of jetting apparatus 100 include a scan pass inkjet printer (e.g., a wide format printer), a multifunction printer, a desktop printer, an industrial printer, a 3D printer, etc. Generally, jetting apparatus 100 includes a mounting frame 102 that supports one or more printheads 104 above a medium 112. Mounting frame 102 may be fixed within jetting apparatus 100 for single-pass printing. Alternatively, mounting frame 102 may be disposed on a carriage assembly that reciprocates back and forth along a scan line or sub-scan direction for multi-pass printing. Printheads 104 are a device, apparatus, or component configured to eject droplets 106 of a marking material, such as ink (e.g., water, solvent, oil, or UV-curable), through a plurality of orifices or nozzles (not visible in FIG. 1). The droplets 106 ejected from the nozzles of printheads 104 are directed toward medium 112. Medium 112 comprises any type of material upon which ink or another marking material is applied by a printhead, such as paper, plastic, card stock, transparent sheets, a substrate for 3D printing, cloth, etc. Typically, nozzles of printheads 104 are arranged in one or more rows so that ejection of a marking material from the nozzles causes formation of characters, symbols, images, layers of an object, etc., on medium 112 as printhead 104 and/or medium 112 are moved relative to one another. Jetting apparatus 100 may include a media transport mechanism 114 or a media holding bed 116. Media transport mechanism 114 is configured to move medium 112 relative to printheads 104. Media holding bed 116 is configured to support medium 112 in a stationary position while the printheads 104 move in relation to medium 112.

Jetting apparatus 100 also includes a jetting apparatus controller 122 that controls the overall operation of jetting apparatus 100. Jetting apparatus controller 122 may connect to a data source to receive image data or another type of data, and control each printhead 104 to discharge the marking material on medium 112. Jetting apparatus 100 also includes one or more reservoirs 124 for the marking material. Although not shown in FIG. 1, reservoirs 124 may be connected to printheads 104 via hoses or the like.

Maintenance operations may be performed to remove old or dry marking material that accumulates on a nozzle surface of the printheads 104. Traditionally, one or more wiper blades may be wiped across the nozzle surface to remove old or dry marking material. Although wipers or the like may be effective, the embodiments described herein use a service media to clean the printheads 104 of a jetting apparatus 100. As a general overview, the service media is inserted beneath one or more printheads 104, and is inflated to contact the nozzle surface of the printhead(s) 104. An absorbent material of the service material absorbs the marking material on the nozzle surface, which acts to clean the printhead 104. The service media may then be deflated and removed from beneath the printhead 104.

Figure 2:
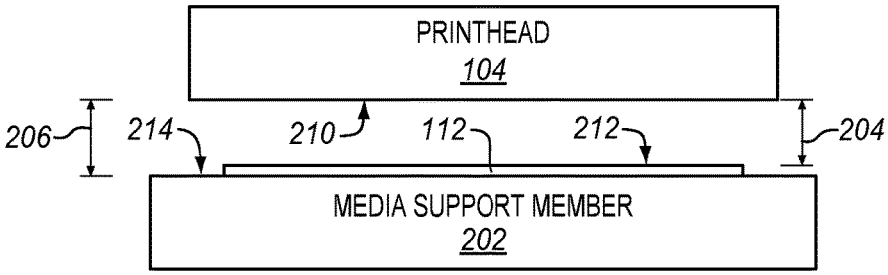
FIG. 2 is a schematic diagram of a printhead in relation to a medium.

FIG. 2 is a schematic diagram of a printhead 104 in relation to medium 112. During jetting operations by printhead 104, medium 112 is supported by a media support member 202. Media support member 202 is a member disposed opposite one or more printheads 104 that supports medium 112 while printheads 104 eject a marking material. Media support member 202 may be part of a media transport mechanism 114, which supports medium 112 while moving beneath printheads 104, or may be part of media holding bed 116. Media transport mechanism 114 may comprise one or more rollers, belts, carriers and/or other devices. A gap 204 is defined between printhead 104 and medium 112, which defines the head height of printhead 104 in relation to medium 112. More particularly, gap 204 may be defined as between a nozzle surface 210 of the printhead 104 and a top surface 212 of medium 112. Although the head height may vary depending on applications, a typical head height may be in the range of 1.5 millimeters (mm) to 4 mm. A gap 206 is also defined between printhead 104 and a top surface 214 of media support member 202. Although printhead 104, medium 112, media transport mechanism 114 and media holding bed 116 are shown as flat, other configurations with curved surface geometries are possible.

Figure 3:
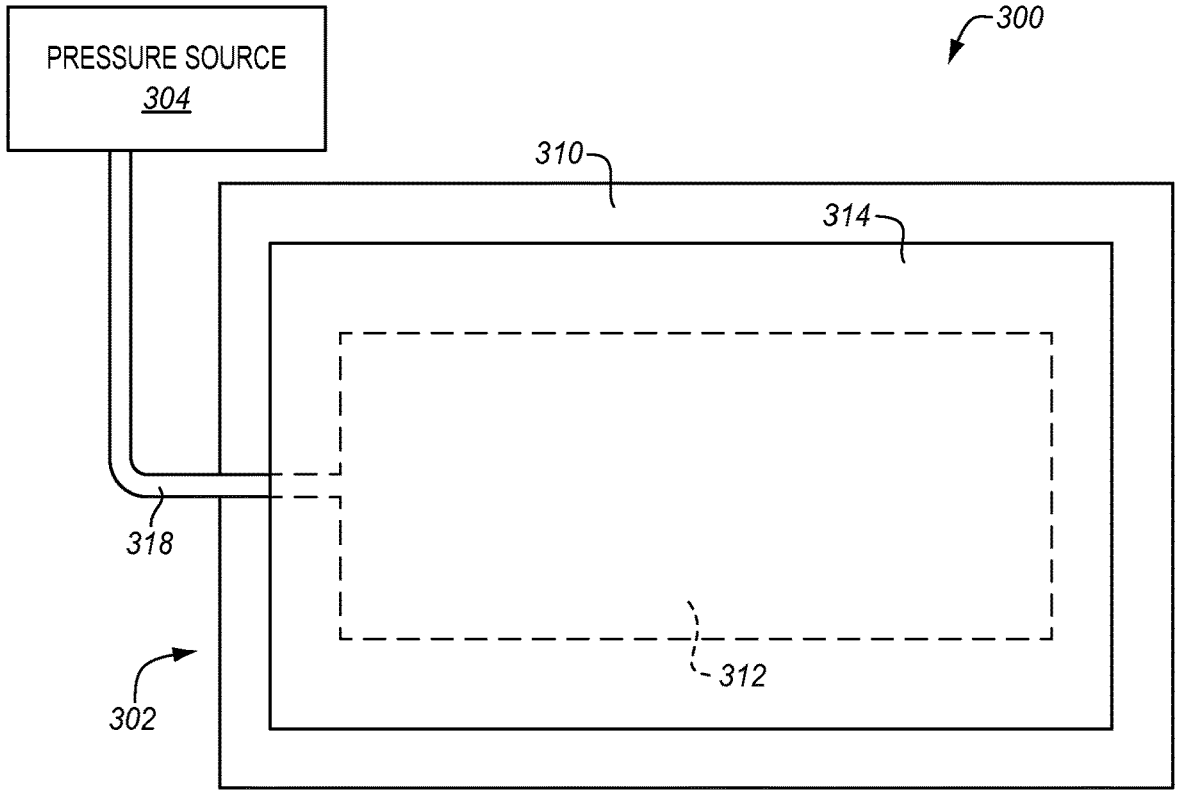
FIG. 3 is a plan view of a cleaning apparatus in an illustrative embodiment.

FIG. 3 is a plan view of a cleaning apparatus 300 in an illustrative embodiment. Cleaning apparatus 300 is configured to perform a cleaning operation on one or more printheads 104 by blotting the nozzle surface 210 of the printhead(s) 104. Cleaning apparatus 300 includes a service media 302 and a pressure source 304. Service media 302 is a piece or sheet of material that is inflatable. Service media 302 includes a backing member 310, an inflatable bladder 312, and an absorbent material 314. As shown in FIG. 3, inflatable bladder 312 is disposed between backing member 310 and the absorbent material 314. Backing member 310 is generally a thin sheet of material that provides support for service media 302. Backing member 310 may be rigid or semi-rigid in some embodiments, such as a polyester or plastic film, or may be generally flexible in other embodiments. Inflatable bladder 312 comprises an expandable bag or container that swells, distends, or otherwise increases in volume due to injection of a fluid (e.g., air, gas, liquid, etc.). Inflatable bladder 312 may have one or more walls that elastically deform due to pressure from an injected fluid. The absorbent material 314 comprises a material configured to absorb or soak up a marking material. For example, the absorbent material 314 may comprise a piece or sheet of a non-woven fabric or cloth, a sponge, paper (e.g., clean-room grade), or the like. In another example, the absorbent material 314 may comprise an absorbent coating, a receptor coating, or the like that is applied to inflatable bladder 312. Backing member 310 and inflatable bladder 312 may be made from a non-absorbent material so that marking material, which is absorbed by the absorbent material 314, does not pass through service media 302. Although inflatable bladder 312 and backing member 310 are shown as separate elements, inflatable bladder 312 and backing member 310 may be a monolithic part in some embodiments. Also, although service media 302 is shown as having a rectangular shape in FIG. 3, it may be other desired shapes in other embodiments.

Pressure source 304 comprises a device, system, or component configured to inject, introduce, or force a fluid into inflatable bladder 312. Inflatable bladder 312 is coupled to pressure source 304 via a port 318. Port 318 is configured to receive a fluid to inflate the inflatable bladder 312, and to discharge the fluid to deflate the inflatable bladder 312. Thus, pressure source 304 is able to inject a fluid into inflatable bladder 312 via port 318 to cause inflatable bladder 312 to swell or distend. Pressure source 304 may comprise a pump, a compressed fluid tank or canister, etc.

Figure 4:
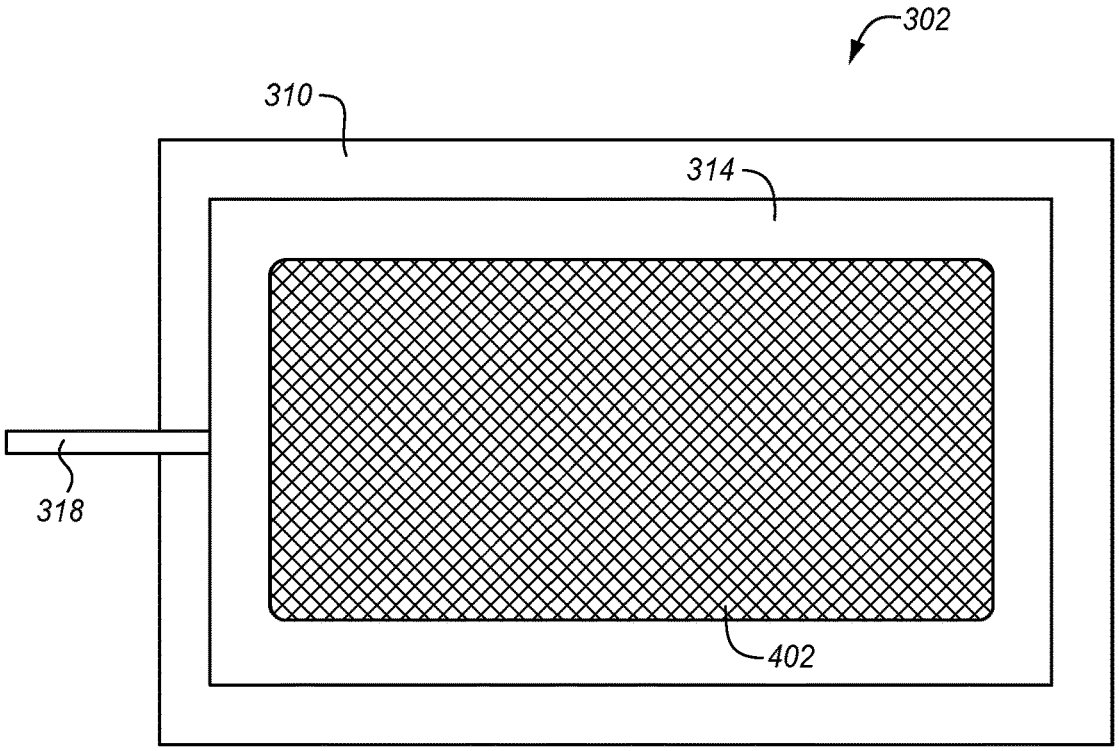
FIG. 4 is a plan view of a service media in an illustrative embodiment.

When in operation, service media 302 is configured for insertion beneath one or more printheads 104, with absorbent material 314 facing the nozzle surface 210 of the printhead(s) 104. Pressure source 304 injects a fluid into inflatable bladder 312, which causes inflatable bladder 312 to inflate and bring the absorbent material 314 into contact with the nozzle surface 210 of the printhead(s) 104. FIG. 4 is a plan view of service media 302 in an illustrative embodiment. Service media 302 may be used to clean a single printhead 104, or a plurality of printheads 104, such as in a printhead array. The absorbent material 314 has a contact area 402 that is at least as large as a footprint of the printhead(s) 104 being cleaned.

Figure 5:
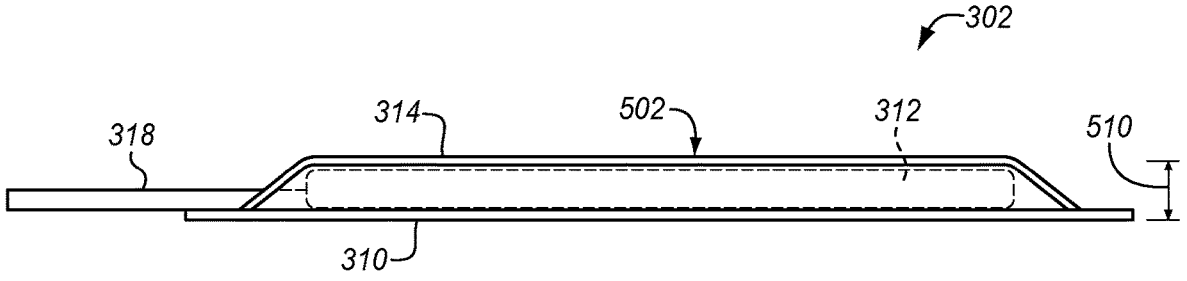
FIGS. 5-7 are side views of a service media in an illustrative embodiment.

FIG. 5 is a side view of service media 302 in an illustrative embodiment. As is evident in this figure, inflatable bladder 312 is disposed between the absorbent material 314 and backing member 310. Service media 302 is generally a thin structure so that it may be inserted beneath printheads 104. In an uninflated state, a thickness 510 of service media 302 may be less than the gap 204 between a printhead(s) 104 and medium 112. For example, the thickness 510 of service media 302 in an uninflated state may be less than 1.5 mm. In another embodiment, the thickness 510 of service media 302 may be less than the gap 206 between a printhead(s) 104 and media support member 202.

Figure 6:
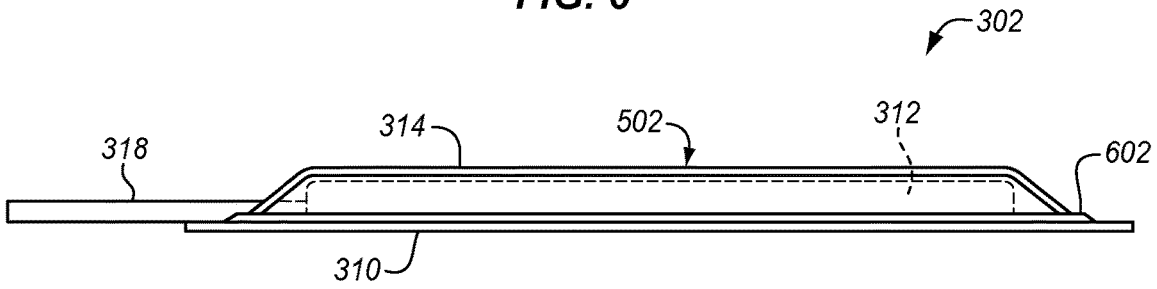
Figure 7:
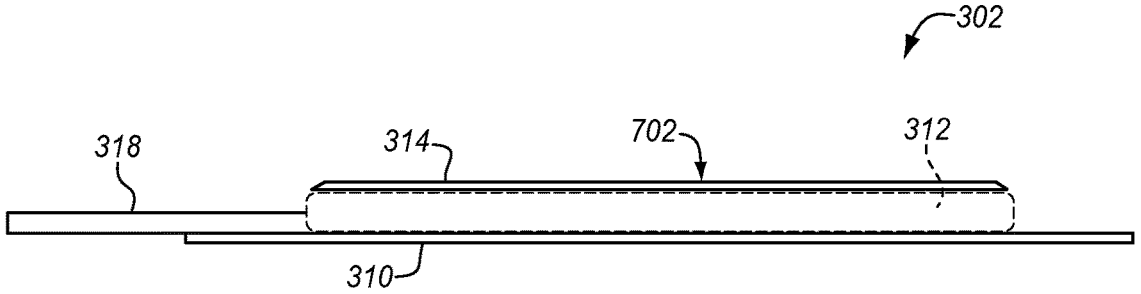

In this embodiment, the absorbent material 314 is comprised of a fabric 502 or cloth (e.g., non-woven fabric) that is coupled, attached, or adhered to backing member 310 as shown in FIG. 5. For example, fabric 502 may be adhered to backing member 310 via an adhesive 602 or the like as shown in FIG. 6. In other embodiments, the absorbent material 314 may be comprised of an absorbent coating 702, receptor coating, or the like that is applied to inflatable bladder 312 as shown in FIG. 7.

Figure 8:
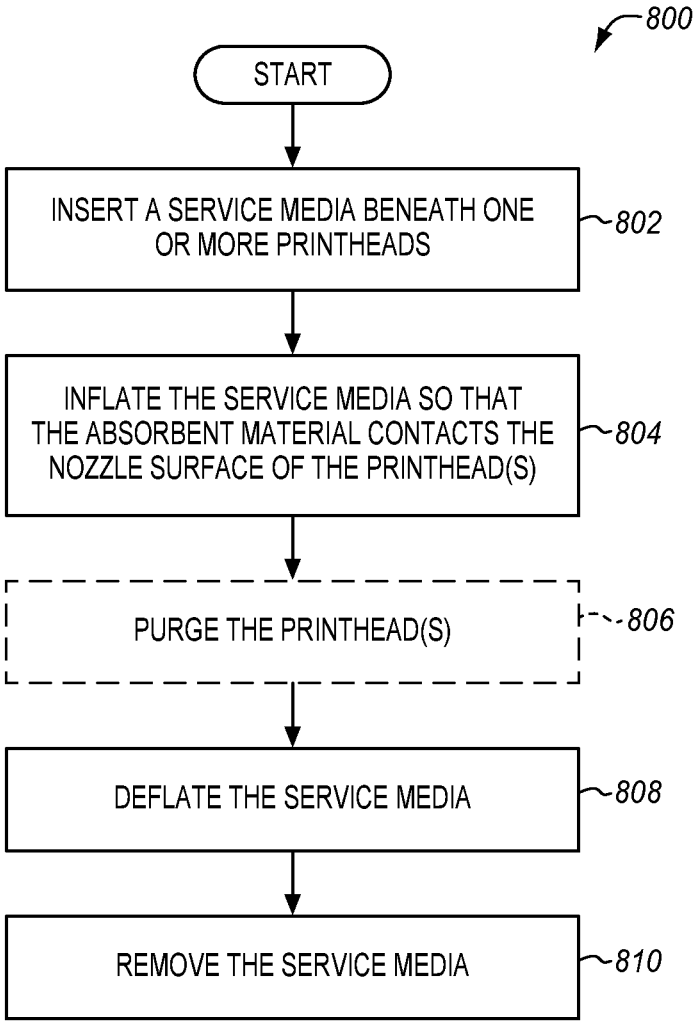
FIG. 8 depicts a flowchart illustrating a method of cleaning one or more printheads in an illustrative embodiment.

FIG. 8 depicts a flowchart illustrating a method 800 of cleaning one or more printheads 104 in an illustrative embodiment. The steps of method 800 are described with reference to jetting apparatus 100 in FIG. 1, but those skilled in the art will appreciate that method 800 may be performed in other systems. The steps of the flowcharts described herein are not all inclusive and may include other steps not shown. The steps described herein may also be performed in an alternative order.

Figure 9:
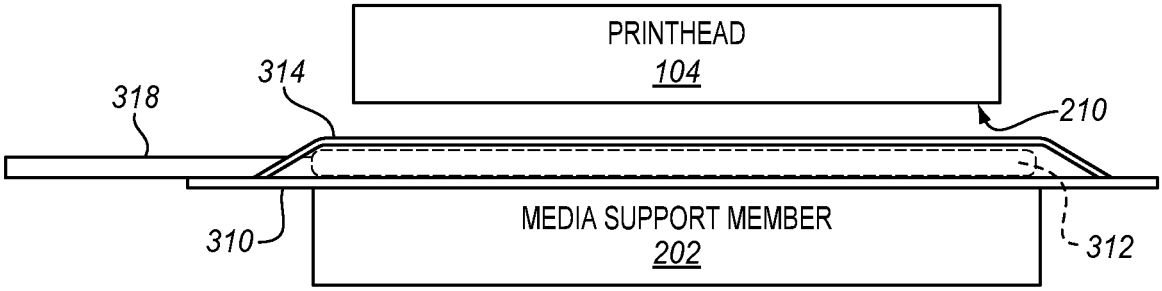
FIG. 9 is a side view of a service media inserted beneath a printhead in an illustrative embodiment.

Method 800 may be performed during a cleaning or maintenance operation of jetting apparatus 100. The service media 302 (i.e., in an uninflated or not fully inflated state) is inserted beneath one or more of the printheads 104 (step 802). FIG. 9 is a side view of service media 302 inserted beneath a printhead 104 in an illustrative embodiment. The term "beneath" indicates that service media 302 is adjacent to printhead 104 with the absorbent material 314 facing nozzles of the printhead 104. FIG. 9 is a side view in one orientation of printhead 104 though it is understood that the service media 302 may be adjacent to nozzle surface 210 in other orientations of printhead 104. As illustrated in FIG. 9, service media 302 may be inserted in the gap 206 between printhead 104 and media support member 202 (see also, FIG. 2). Backing member 310 may therefore rests directly on media support member 202 with the absorbent material 314 facing the nozzle surface 210 of the printhead 104. Although not shown in FIG. 9, medium 112 may be present on media support member 202 during a cleaning operation. Thus, service media 302 may be inserted in the gap 204 between printhead 104 and medium 112, with backing member 310 resting on medium 112.

Figure 10:
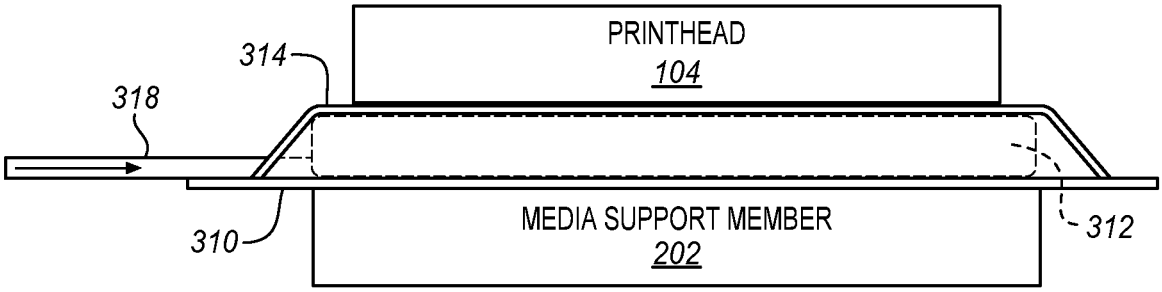
FIG. 10 is a side view of a service media inflated in an illustrative embodiment.

With the service media 302 arranged in a desired position, the service media 302 is inflated so that the absorbent material 314 contacts the nozzle surface 210 of the printhead(s) 104 (step 804). For example, pressure source 304 may inject an air, gas, or another type of fluid into inflatable bladder 312 (see FIG. 3), which causes service media 302 to inflate. FIG. 10 is a side view of service media 302 inflated in an illustrative embodiment. Service media 302 inflates within gap 204/206 so that the absorbent material 314 is pressed against the nozzle surface 210 of the printhead(s) 104. When contacting the nozzle surface 210, the absorbent material 314 of service media 302 absorbs the marking material on the nozzle surface 210. Service media 302 is held stationary when inflated to perform blotting of the nozzle surface 210 as opposed to wiping the nozzle surface 210.

In FIG. 8, printhead(s) 104 may be purged or flushed with service media 302 inflated (optional step 806). For example, the source of the marking material (e.g., reservoir 124 in FIG. 1) may be pressurized to force marking material to ooze or seep out of the nozzles of printhead(s) 104 for a particular time or a particular amount. In another example, one or more of the jetting channels of printhead(s) 104 may be actuated to jet one or more droplets of the marking material out of the nozzles. In yet another example, marking material may be discharged from printhead(s) 104 by purging and jetting. The absorbent material 314 of service media 302 absorbs the marking material discharged from the nozzles of printhead(s) 104.

Figure 11:
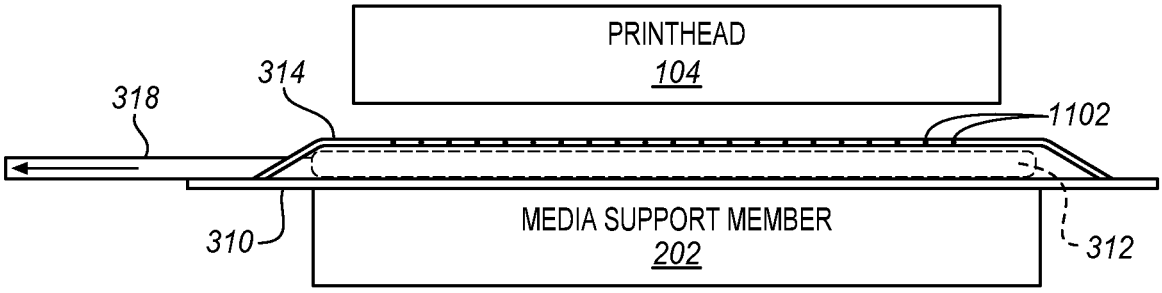
FIG. 11 is a side view of a service media deflated in an illustrative embodiment.

Service media 302 may be held stationary in its inflated state for a threshold time to allow the absorbent material 314 to soak up the marking material from the printhead(s) 104. Service media 302 is then deflated (step 808), such as after the threshold time has expired. For example, the port 318 of inflatable bladder 312 may be opened to release the fluid from inflatable bladder 312. FIG. 11 is a side view of service media 302 deflated in an illustrative embodiment. With service media 302 deflated, blots 1102 of marking material are visible on the absorbent material 314 that were cleaned from printhead(s) 104. In FIG. 8, service media 302 may then be removed from beneath printhead(s) 104 (step 810). Service media 302 may be discarded, or the absorbent material 314 may be replaced on service media 302.

Figure 12:
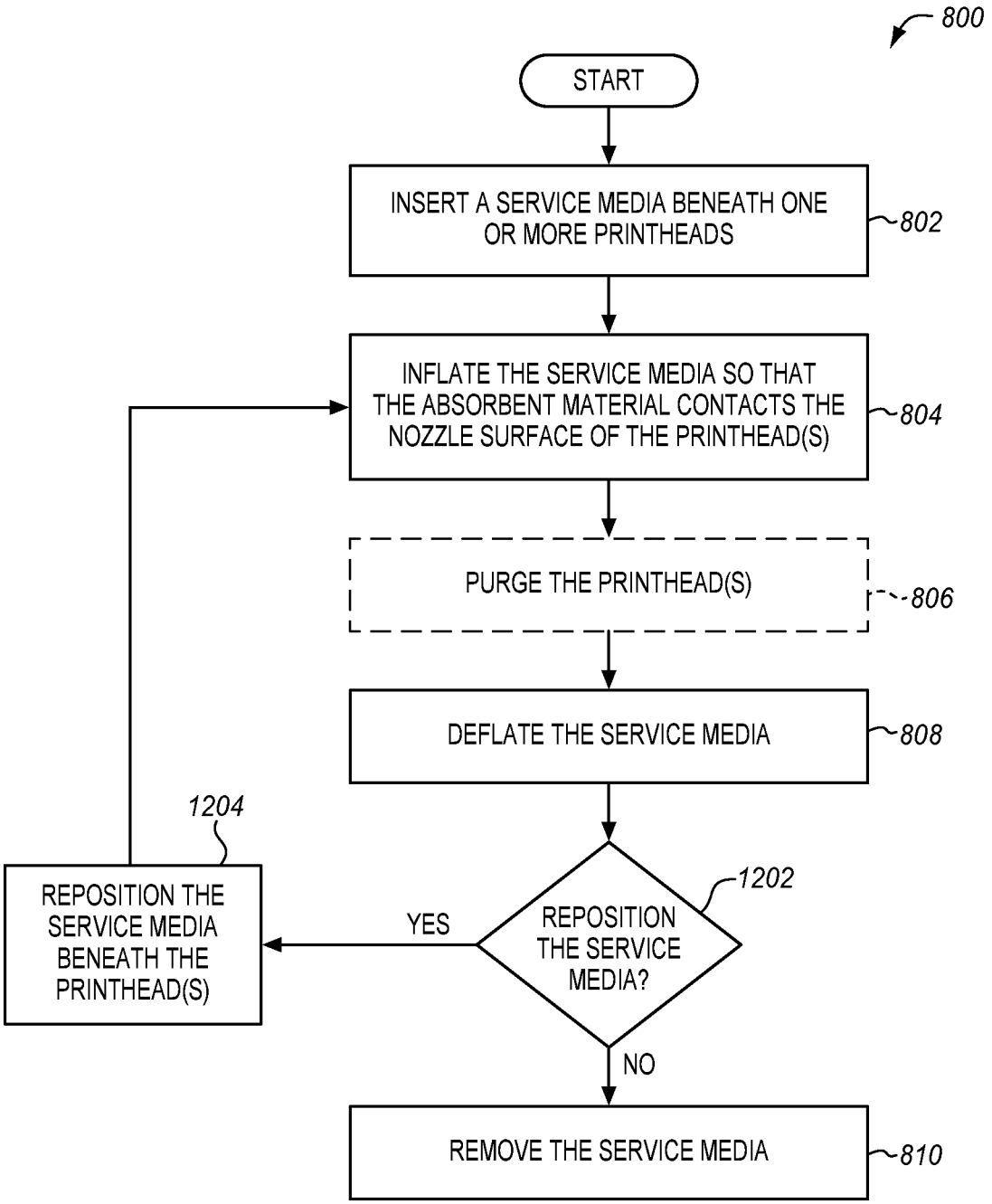
FIG. 12 is a flow chart illustrating additional steps of the method in FIG. 8 in an illustrative embodiment.

In another embodiment, service media 302 may be inflated more than one time for a cleaning operation. FIG. 12 is a flow chart illustrating additional steps of method 800 in an illustrative embodiment. After deflating service media 302 (step 808), a decision may be made whether to reposition service media 302 (step 1202). When the decision is not to reposition, service media 302 is removed from beneath the printhead(s) 104 (step 810). When the decision is to reposition, service media 302 is repositioned beneath the printhead(s) 104 (step 1204). For example, when service media 302 is inflated, a portion of the absorbent material 314 contacts the nozzle surface 210 of the printhead(s) 104 and absorbs the marking material. However, other portions of the absorbent material 314 are not brought into contact with the nozzle surface 210, and remained unsoiled by the marking material. Thus, when deflated, service media 302 may be repositioned so that the unsoiled portions of the absorbent material 314 are adjacent to the printhead(s) 104. There may be a visual grid or the like on service media 302 to assist in repositioning the service media 302 in step 1204. Method 800 then returns to step 804 where the service media 302 is inflated at a different position beneath printhead(s) 104.

Method 800 and the use of service media 302 provides a technical benefit in that printhead(s) 104 is cleaned by service media 302 with a blotting action. Service media 302 is held stationary when inflated to absorb marking material from the printhead(s) 104, as opposed to a wiping action. This helps protect the delicate nozzle surface 210 during a cleaning operation. Another benefit is that service media 302 is able to conform to the contour of the printhead(s). As will be described in more detail below, printhead(s) 104 may be installed in a mounting frame 102 (see FIG. 1) so that the nozzle surface 210 is flush with a bottom surface of mounting frame 102, is recessed in relation to the bottom surface, or projects from the bottom surface. When inflated, the absorbent material 314 of service media 302 is able to contact the nozzle surface 210 even when the nozzle surface 210 is recessed in relation to the bottom surface of the mounting frame 102.

Figure 13:
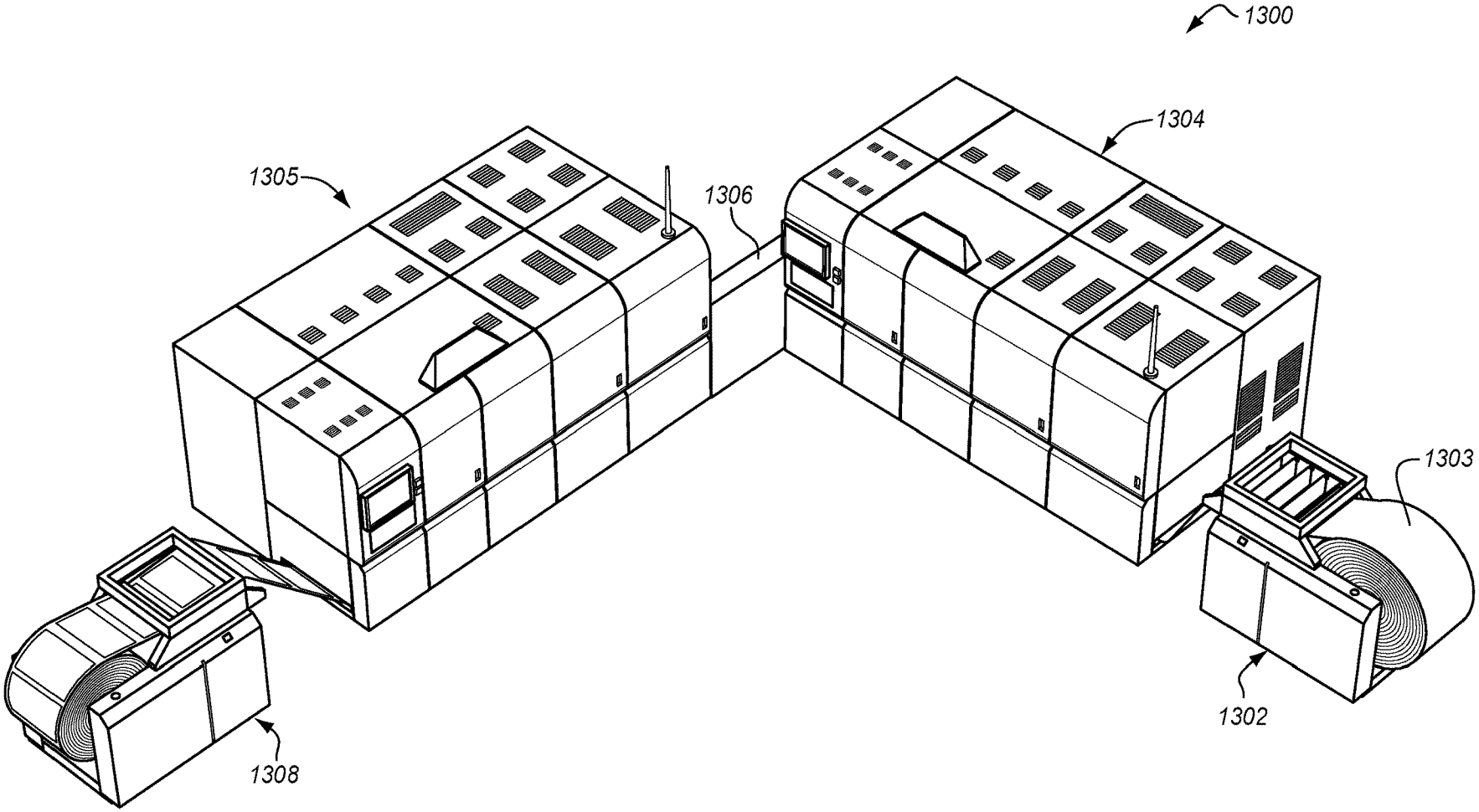
FIG. 13 is a perspective view of a continuous-feed printer.

One use of service media 302 is for cleaning printheads 104 in a continuous-feed printer. FIG. 13 is a perspective view of a continuous-feed printer 1300. Continuous-feed printer 1300 is a type of production printer that is capable of high-speed or volume printing. Continuous-feed printer 1300 includes an unwind finishing device 1302 that stores a roll of print media, which is generally referred to as a web 1303. Continuous-feed printer 1300 further includes base units 1304-1305 that each house a plurality of printheads. Base units 1304-1305 may be able to apply one or more types of marking material onto web 1303. The applied marking material may comprise ink in the form of any suitable fluid (e.g., aqueous inks, oil-based paints, additive manufacturing materials, etc.) for marking web 1303. For example, base units 1304-1305 may be capable of applying different colors of marking material, such as Cyan (C), Magenta (M), Yellow (Y), and Key (K) black ink, and/or may be capable of applying formulas for pre-coating, undercoating, protector coating, or the like. Base unit 1304 is configured to print on one side of web 1303, and base unit 1305 is configured to print on the other side of web 1303 after being turned by a turner bar unit 1306. Continuous-feed printer 1300 also includes a rewind finishing device 1308 that takes up web 1303 after printing by base units 1304-1305. The configuration of continuous-feed printer 1300 is just an example, as continuous-feed printer 1300 may include other or alternative units.

Figure 14:
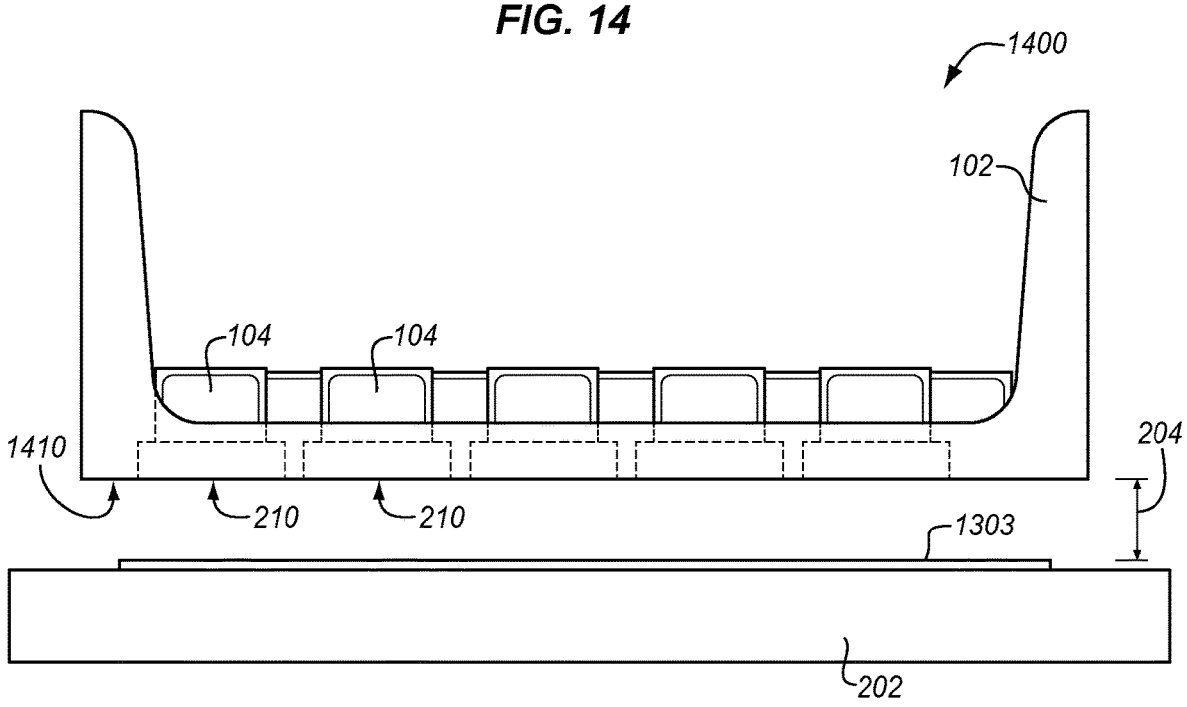
FIGS. 14-16 are side views of a printhead assembly.
Figure 15:
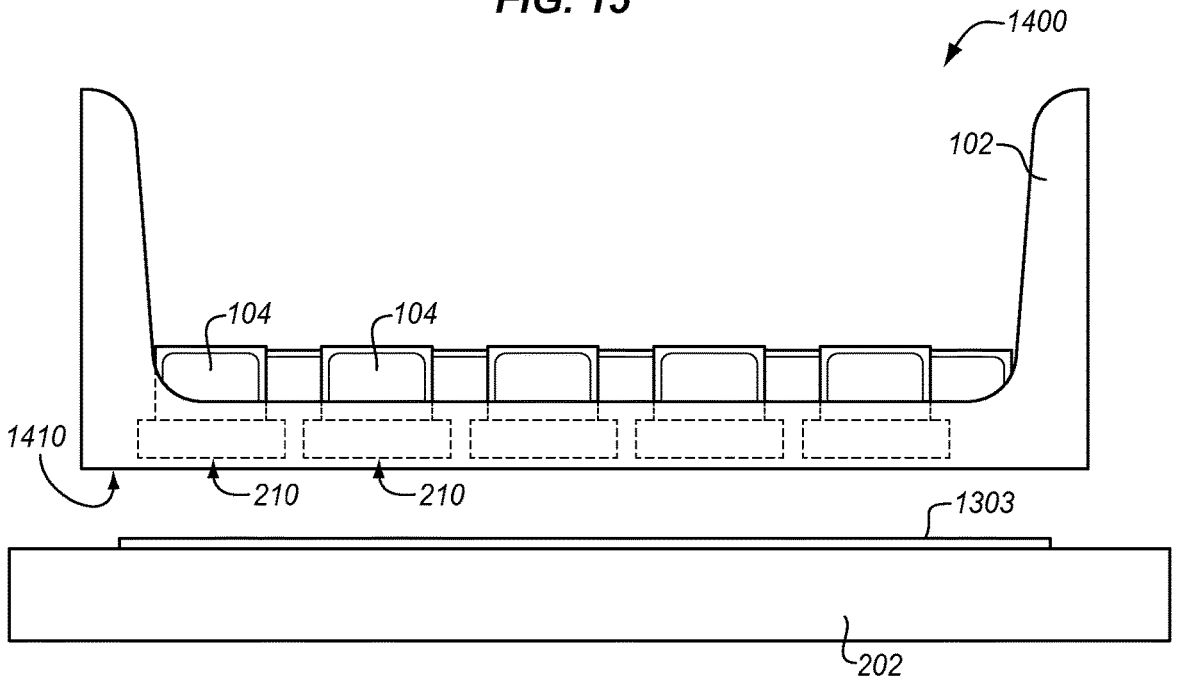
Figure 16:
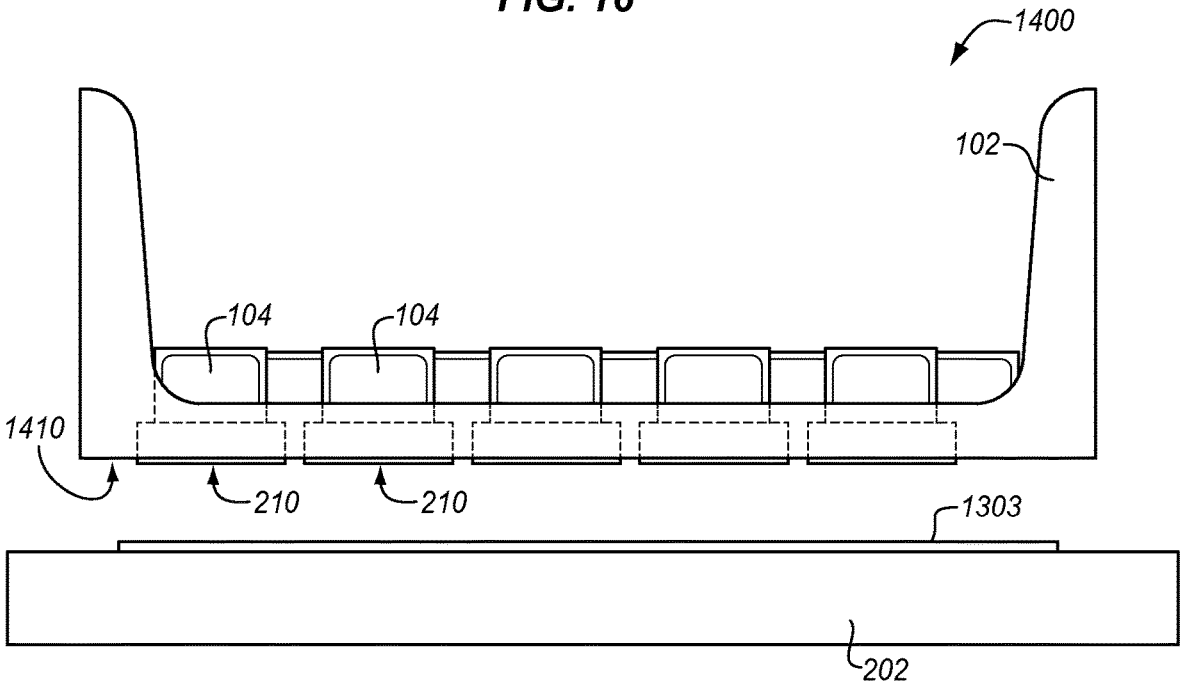

Although not shown in FIG. 13, the printheads 104 in base units 1304-1305 are installed in printhead assemblies. FIGS. 14-16 are side views of a printhead assembly 1400. Printhead assembly 1400 includes a mounting frame 102, and a plurality of printheads 104 mounted on mounting frame 102. Also shown is a media support member 202 opposite printhead assembly 1400, which supports web 1303 while it moves underneath printheads 104 (which would be into the page in FIG. 14). Printheads 104 are disposed above web 1303 with a gap 204 between the nozzle surface 210 of the printheads 104 and web 1303. In FIG. 14, printheads 104 are mounted flush with a bottom surface 1410 of mounting frame 102. In FIG. 15, printheads 104 are recessed in relation to the bottom surface 1410 of mounting frame 102. In FIG. 16, printheads 104 project from the bottom surface 1410 of mounting frame 102.

Figure 17:
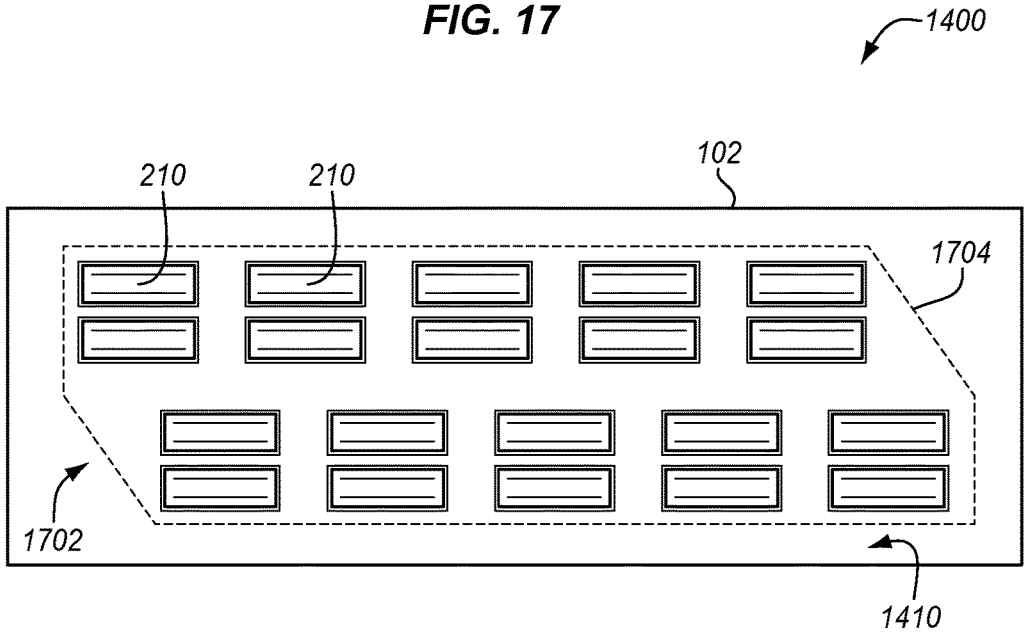
FIG. 17 is a bottom view of a printhead assembly.

FIG. 17 is a bottom view of printhead assembly 1400. In this view, the nozzle surface 210 of printheads 104 are visible in relation to the bottom surface 1410 of mounting frame 102. Printheads 104 are arranged in rows to form a printhead array 1702 (having a footprint 1704) that is able to print across a width of web 1303. Printhead array 1702 may be for one type of marking material, such as one color of ink. Thus, a base unit 1304-1305 of continuous-feed printer 1300 (see FIG. 13) may include multiple printhead assemblies 1400, such as a printhead assembly 1400 for each color, a printhead assembly 1400 for a pre-coat, etc.

Figure 18:
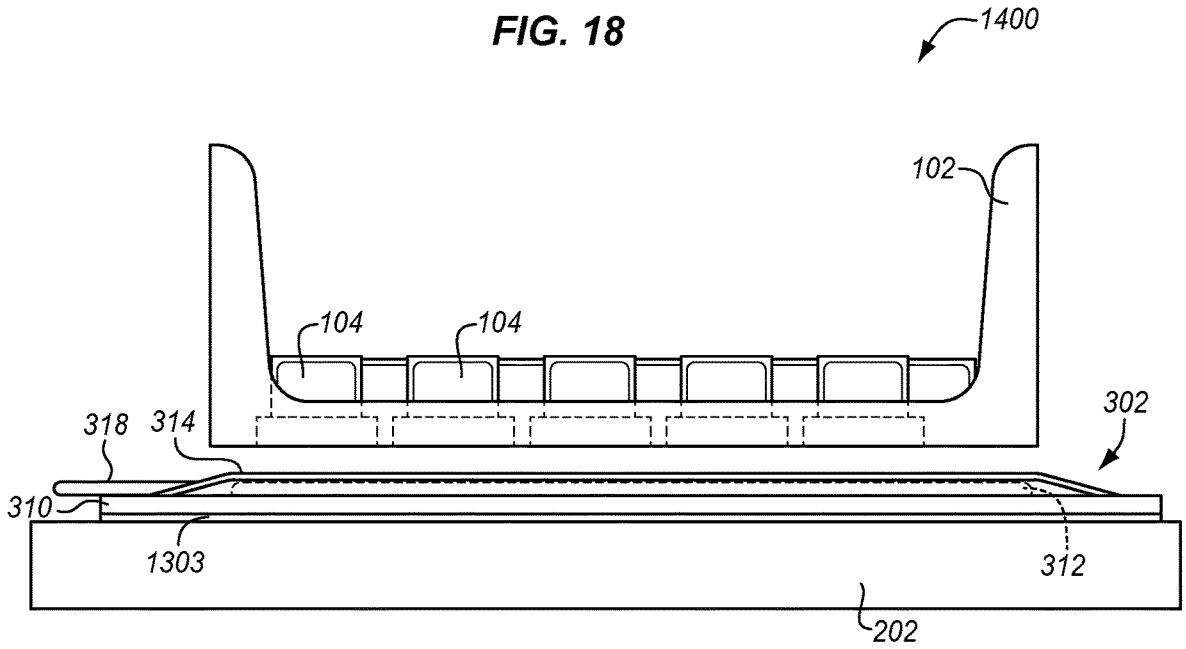
FIG. 18 is a side view of a service media inserted beneath printheads in an illustrative embodiment.
Figure 19:
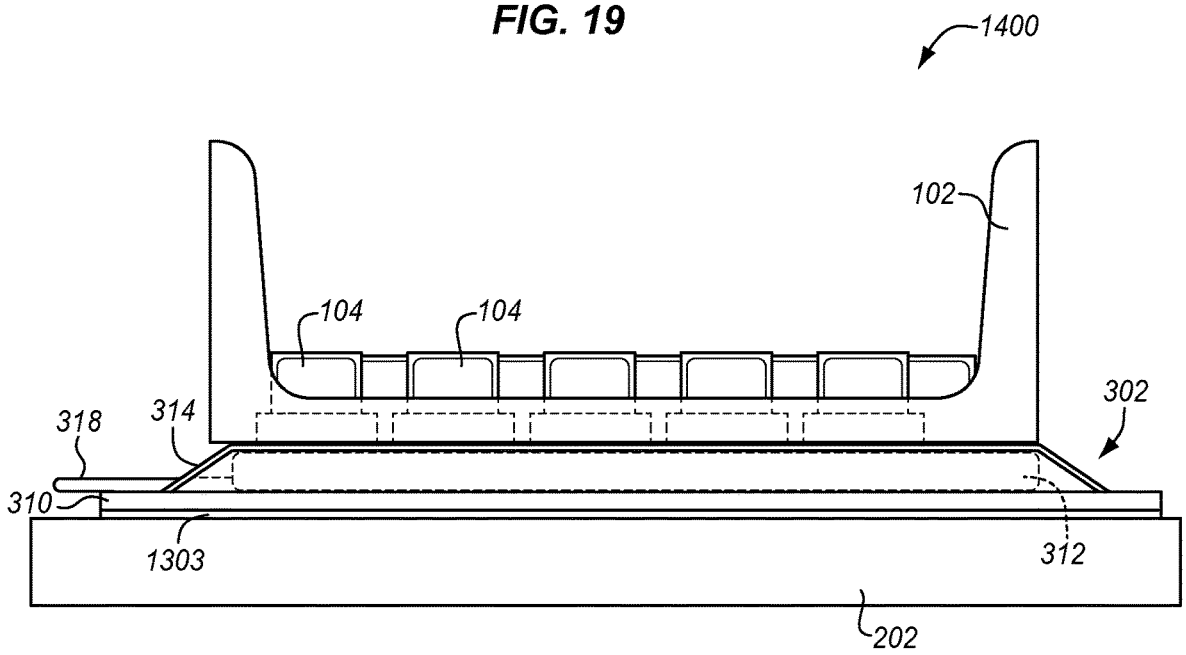
FIG. 19 is a side view of a service media inflated in an illustrative embodiment.
Figure 20:
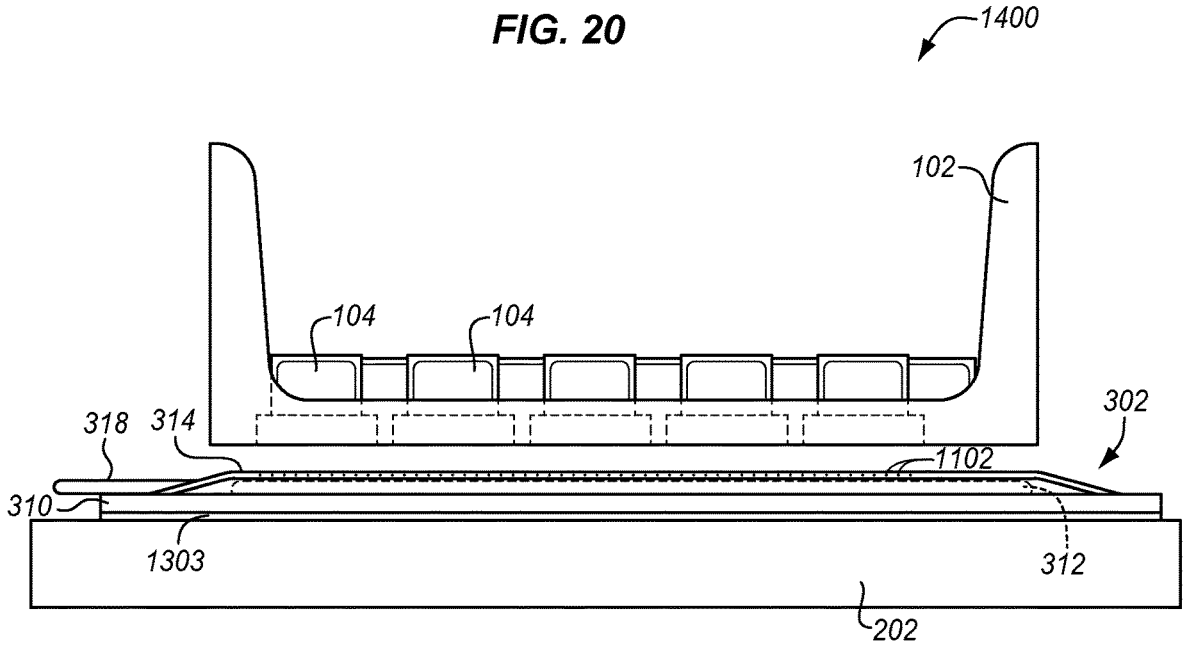
FIG. 20 is a side view of a service media deflated in an illustrative embodiment.

To clean printheads 104 of printhead assembly 1400, service media 302 as described above may be used. A service media 302 is acquired that is large enough for the footprint 1704 of printhead array 1702. In other words, the contact area 402 (see FIG. 4) of the absorbent material 314 is at least as large as the footprint 1704 of printhead array 1702. A service door in a base unit 1304-1305 may be opened to expose an area below printhead assembly 1400. Service media 302 (i.e., in an uninflated or not fully inflated state) is inserted beneath the printheads 104 of printhead assembly 1400 (see step 802 of FIG. 8) transverse to travel direction of web 1303. FIG. 18 is a side view of service media 302 inserted beneath printheads 104 in an illustrative embodiment. Service media 302 is inserted in the gap 204 between printheads 104 and web 1303, with backing member 310 resting on top of web 1303. This is advantageous in that web 1303 does not have to be cut or re-routed for a cleaning operation. In other embodiments, service media 302 may be inserted directly on top of media support member 202. With service media 302 arranged in a desired position, service media 302 is inflated so that the absorbent material 314 contacts the nozzle surface 210 of the printheads 104 (see step 804 of FIG. 8). FIG. 19 is a side view of service media 302 inflated in an illustrative embodiment. Service media 302 inflates within the gap 204 so that the absorbent material 314 is pressed against the nozzle surface 210 of the printheads 104. Printheads 104 are purged or flushed with service media 302 inflated (see step 806 of FIG. 8). Service media 302 is held stationary in its inflated state for a threshold time to allow the absorbent material 314 to soak up the marking material from the printhead(s) 104. Service media 302 is then deflated (see step 808 of FIG. 8). FIG. 20 is a side view of service media 302 deflated in an illustrative embodiment. With service media 302 deflated, blots 1102 of marking material are visible on the absorbent material 314 that were cleaned from printheads 104. Service media 302 may then be removed from beneath printheads 104 (see step 810 of FIG. 8). A similar process may be performed for other printhead assemblies 1400 of continuous-feed printer 1300.

One technical benefit of using service media 302 for a cleaning operation of continuous-feed printer 1300 is that a printhead assembly 1400 does not have to move for the cleaning operation. Service media 302 may be inserted beneath printhead assembly 1400 in its printing position. Thus, printhead assembly 1400 does not have to be slid outward from a base unit 1304-1305 for cleaning. Also, printhead assembly 1400 does not require mechanisms that allow mounting frame 102 to move vertically for cleaning operations. Another benefit is that service media 302 is able to conform to the contour of the bottom surface 1410 of mounting frame 102. Thus, even when the nozzle surface 210 of printheads 104 is recessed as in FIG. 15, the absorbent material 314 of service media 302 is able to contact the nozzle surface 210 for cleaning.

Figure 21:
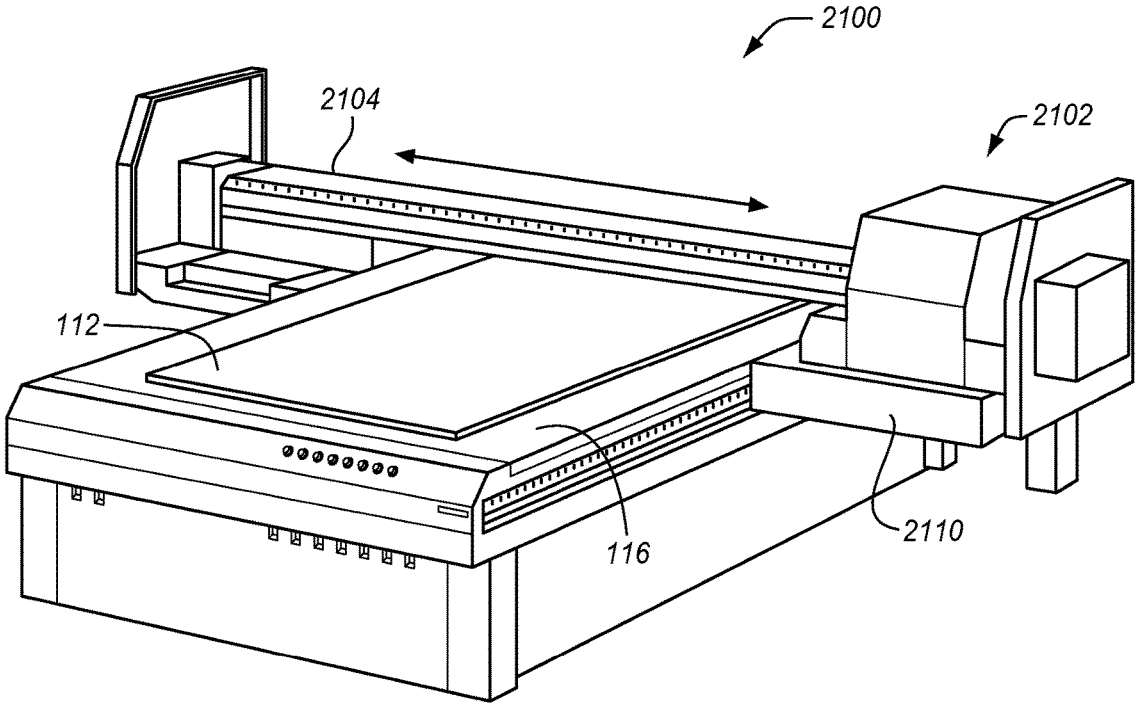
FIG. 21 is a perspective view of a scan pass inkjet printer.

Another use of service media 302 is for cleaning printheads 104 in a scan pass inkjet printer. FIG. 21 is a perspective view of a scan pass inkjet printer 2100. Scan pass inkjet printer 2100 has a media holding bed 116 that supports a medium 112, and a printhead assembly 2102 that reciprocates back and forth over medium 112 via a carriage rail 2104. In the type of scan pass inkjet printer 2100 shown in FIG. 21, medium 112 is stationary on media holding bed 116 during printing. However, other types of scan pass inkjet printers 2100 may include a media transport mechanism 114 that moves medium 112 during printing. Scan pass inkjet printer 2100 also has a maintenance station 2110 offset from media holding bed 116. Printhead assembly 2102 is parked at maintenance station 2110 when not performing a print operation. When at maintenance station 2110, printheads 104 may be capped to prevent drying of marking material, cleaning operations may be performed, etc.

Figure 22:
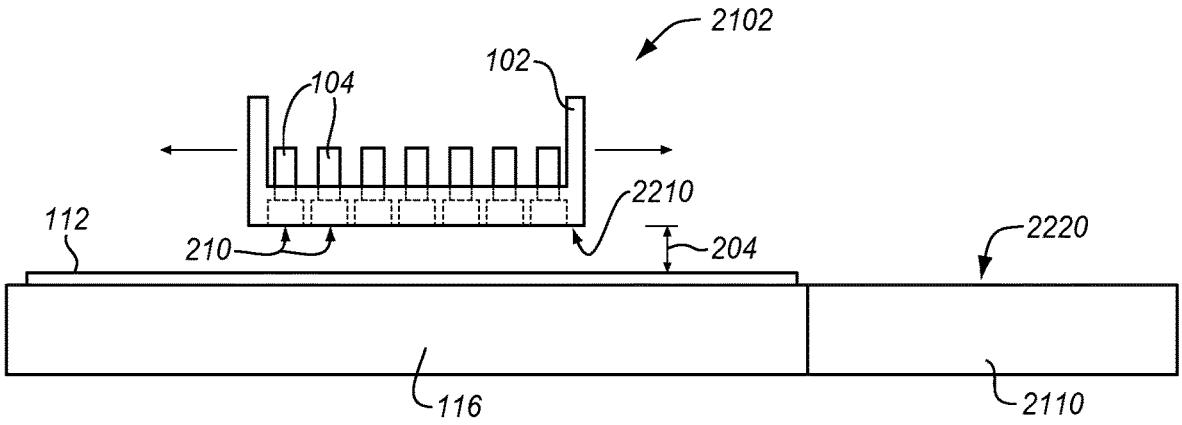
FIG. 22 is a side view of a printhead assembly.

FIG. 22 is a side view of printhead assembly 2102. Printhead assembly 2102 includes a mounting frame 102, and a plurality of printheads 104 (e.g., CMYK printheads) mounted on mounting frame 102. Also shown is media holding bed 116 opposite printhead assembly 2102 that supports medium 112. Printheads 104 are disposed above medium 112 with a gap 204 between the nozzle surface 210 of the printheads 104 and medium 112. Although printheads 104 are mounted flush with a bottom surface 2210 of mounting frame 102, printheads 104 may be recessed in relation to the bottom surface 2210 of mounting frame 102, or may project from the bottom surface 2210 of mounting frame 102. Also shown is maintenance station 2110 that has a maintenance bed 2220.

Figure 23:
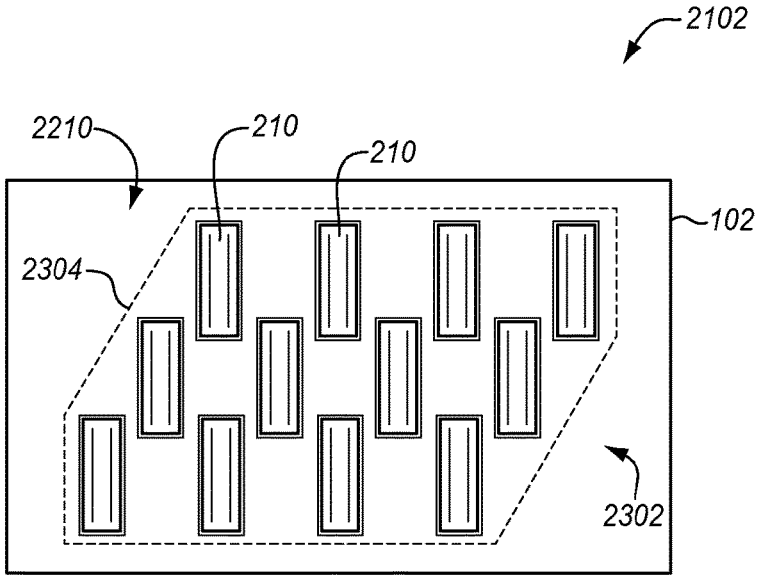
FIG. 23 is a bottom view of a printhead assembly.

FIG. 23 is a bottom view of printhead assembly 2102. In this view, the nozzle surface 210 of printheads 104 are visible in relation to the bottom surface 2210 of mounting frame 102. Printheads 104 are arranged in rows to form a printhead array 2302 (having a footprint 2304) that can print four types of marking material, such as four colors of ink.

Figure 24:
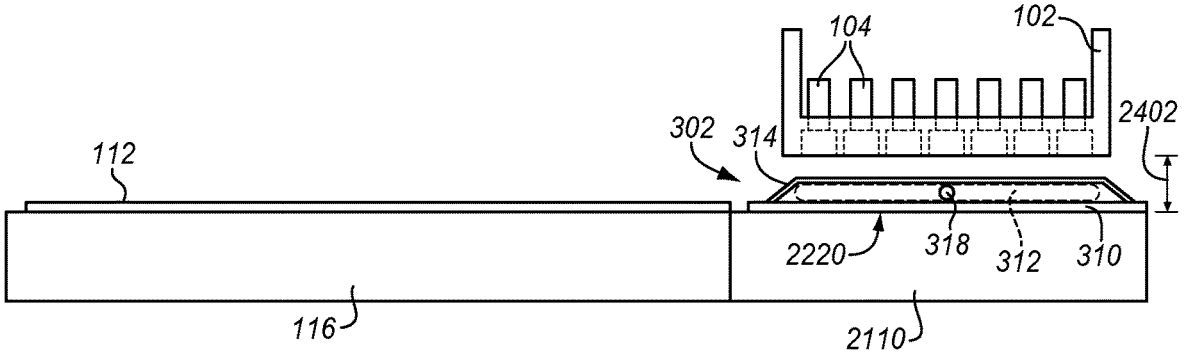
FIG. 24 is a side view of a service media inserted beneath printheads in an illustrative embodiment.
Figure 25:
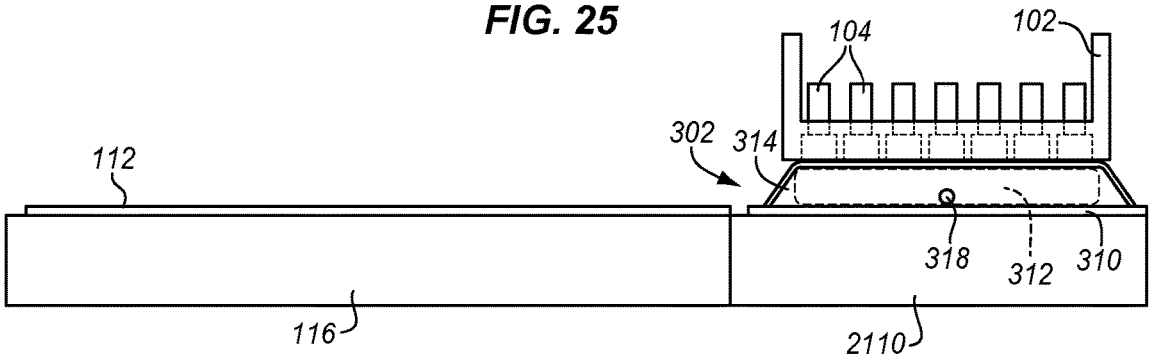
FIG. 25 is a side view of a service media inflated in an illustrative embodiment.
Figure 26:
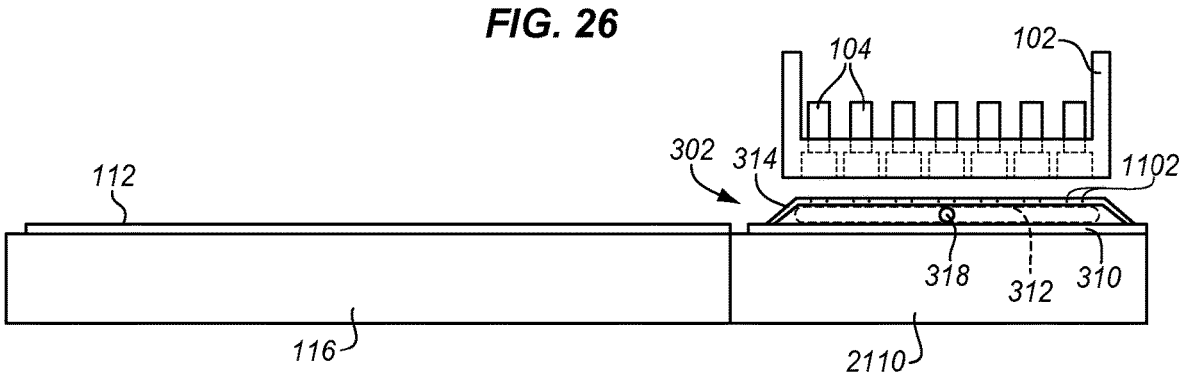
FIG. 26 is a side view of a service media deflated in an illustrative embodiment.

To clean printheads 104 of printhead assembly 2102, service media 302 as described above may be used. A service media 302 is acquired that is large enough for the footprint 2304 of printhead array 2302. In other words, the contact area 402 (see FIG. 4) of the absorbent material 314 is at least as large as the footprint 2304 of printhead array 2302. Service media 302 (i.e., in an uninflated or not fully inflated state) is inserted beneath the printheads 104 of printhead assembly 2102 (see step 802 of FIG. 8). FIG. 24 is a side view of service media 302 inserted beneath printheads 104 in an illustrative embodiment. In this embodiment, service media 302 is inserted in a gap 2402 between printheads 104 and maintenance bed 2220 of maintenance station 2110. However, service media 302 may be inserted in the gap 204 between printheads 104 and medium 112 or media holding bed 116 in other embodiments. With service media 302 arranged in a desired position, service media 302 is inflated so that the absorbent material 314 contacts the nozzle surface 210 of the printheads 104 (see step 804 of FIG. 8). FIG. 25 is a side view of service media 302 inflated in an illustrative embodiment. Service media 302 inflates within the gap 2402 so that the absorbent material 314 is pressed against the nozzle surface 210 of the printheads 104. Printheads 104 are purged or flushed with service media 302 inflated (see step 806 of FIG. 8). Service media 302 is held stationary in its inflated state for a threshold time to allow the absorbent material 314 to soak up the marking material from the printhead(s) 104. Service media 302 is then deflated (see step 808 of FIG. 8). FIG. 26 is a side view of service media 302 deflated in an illustrative embodiment. With service media 302 deflated, blots 1102 of marking material are visible on the absorbent material 314 that were cleaned from printheads 104. Service media 302 may then be removed from beneath printheads 104 (see step 810 of FIG. 8).

Figure 27:
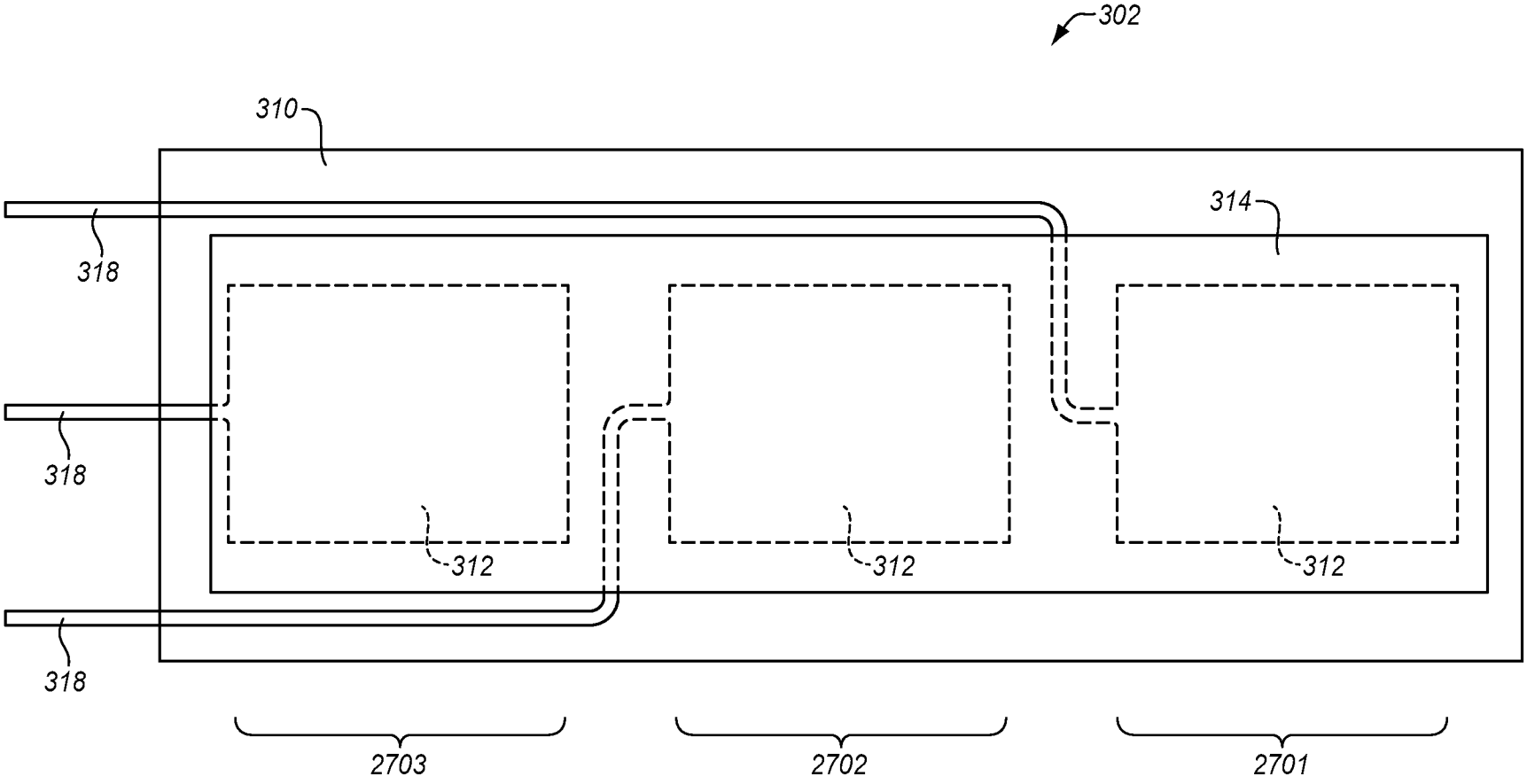
FIG. 27 is a plan view of a service media in another illustrative embodiment.

FIG. 27 is a plan view of service media 302 in another illustrative embodiment. In this embodiment, service media 302 includes a plurality of inflatable bladders 312. Each of inflatable bladders 312 are fluidly discrete or unconnected, and are independently inflatable to define independent sections 2701-2703. Each of inflatable bladders 312 includes a port 318 that is coupled to a pressure source 304 (not shown). With this configuration, service media 302 may be repositioned beneath printheads 104. For example, section 2701 of service media 302 may be positioned beneath printheads 104, and the inflatable bladder 312 of section 2701 is inflated so that the absorbent material 314 of section 2701 contacts the nozzle surface 210 of the printheads 104. The inflatable bladder 312 of section 2701 may then be deflated, and service media 302 may be repositioned so that section 2702 is beneath printheads 104. The inflatable bladder 312 of section 2702 is inflated so that the absorbent material 314 of section 2702 contacts the nozzle surface 210 of the printheads 104. The inflatable bladder 312 of section 2702 may then be deflated, and service media 302 may be repositioned so that section 2703 is beneath printheads 104. The inflatable bladder 312 of section 2703 is inflated so that the absorbent material 314 of section 2703 contacts the nozzle surface 210 of the printheads 104. The inflatable bladder 312 of section 2703 may then be deflated, and service media 302 may be removed. Although three sections 2701-2703 are shown in FIG. 27, service media 302 may have more or less sections 2701-2703 in other embodiments.

Figure 28:
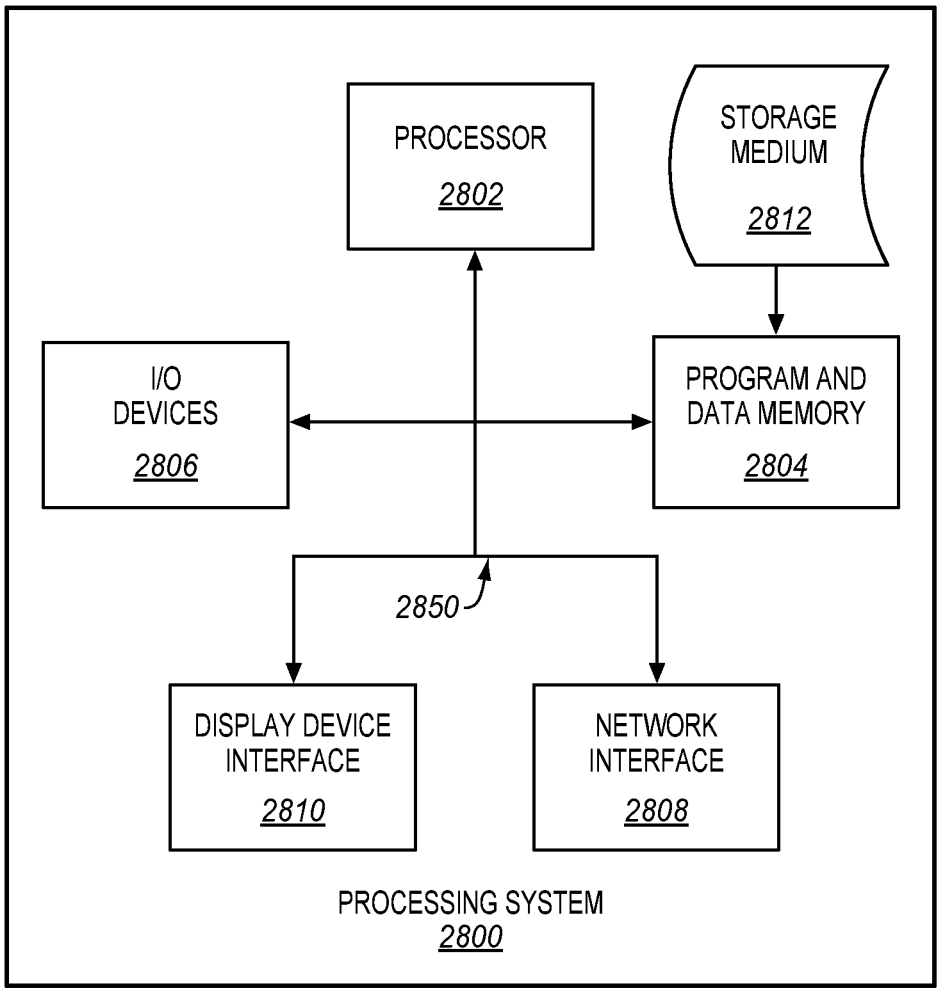
FIG. 28 illustrates a processing system operable to execute a computer readable medium embodying programmed instructions to perform desired functions in an illustrative embodiment.

Embodiments disclosed herein can take the form of software, hardware, firmware, or various combinations thereof. In one particular embodiment, software is used to direct a processing system of jetting apparatus 100 to perform the various operations disclosed herein. FIG. 28 illustrates a processing system 2800 operable to execute a computer readable medium embodying programmed instructions to perform desired functions in an illustrative embodiment. Processing system 2800 is operable to perform the above operations by executing programmed instructions tangibly embodied on computer readable storage medium 2812. In this regard, embodiments can take the form of a computer program accessible via computer-readable medium 2812 providing program code for use by a computer or any other instruction execution system. For the purposes of this description, computer readable storage medium 2812 can be anything that can contain or store the program for use by the computer.

Computer readable storage medium 2812 can be an electronic, magnetic, optical, electromagnetic, infrared, or semiconductor device. Examples of computer readable storage medium 2812 include a solid-state memory, a magnetic tape, a removable computer diskette, a random access memory (RAM), a read-only memory (ROM), a rigid magnetic disk, and an optical disk. Current examples of optical disks include compact disk—read only memory (CD-ROM), compact disk—read/write (CD-R/W), and DVD.

Processing system 2800, being suitable for storing and/or executing the program code, includes at least one processor 2802 coupled to program and data memory 2804 through a system bus 2850. Program and data memory 2804 can include local memory employed during actual execution of the program code, bulk storage, and cache memories that provide temporary storage of at least some program code and/or data in order to reduce the number of times the code and/or data are retrieved from bulk storage during execution.

I/O devices 2806 (including but not limited to keyboards, displays, pointing devices, etc.) can be coupled either directly or through intervening I/O controllers. Network adapter interfaces 2808 may also be integrated with the system to enable processing system 2800 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 2810 may be integrated with the system to interface to one or more display devices, such as printing systems and screens for presentation of data generated by processor 2802.

Although specific embodiments are described herein, the scope of the disclosure is not limited to those specific embodiments. The scope of the disclosure is defined by the following claims and any equivalents thereof.

What is claimed is:

1. A method of cleaning one or more printheads, the method comprising:

inserting a service media beneath the one or more printheads;

inflating the service media so that an absorbent material of the service media contacts a nozzle surface of the one or more printheads while the service media is held stationary to perform blotting of the nozzle surface; and deflating the service media after a threshold time where the service media is held stationary when inflated.

2. The method of claim 1 further comprising:

purging the one or more printheads with the service media inflated.

3. The method of claim 1 further comprising:

repositioning the service media beneath the one or more printheads;

inflating the service media so that the absorbent material of the service media contacts the nozzle surface of the one or more printheads while the service media is held stationary to perform blotting of the nozzle surface; and deflating the service media.

4. The method of claim 1 further comprising:

removing the service media from beneath the one or more printheads.

5. The method of claim 1 wherein inserting the service media comprises:

inserting the service media in a gap between the one or more printheads and a web of print media.

6. The method of claim 1 wherein inserting the service media comprises:

inserting the service media in a gap between the one or more printheads and a media support member that supports a medium during printing.

7. The method of claim 1 wherein:

the service media includes an inflatable bladder; and inflating the service media comprises injecting a fluid into the inflatable bladder.

8. A method of cleaning an array of printheads in a continuous-feed printer, the method comprising:

inserting a service media beneath the array of the printheads;

inflating the service media so that an absorbent material of the service media contacts a nozzle surface of the printheads in the array, wherein the service media is held stationary when inflated;

purging the printheads with the service media inflated; and deflating the service media after a threshold time where the service media is held stationary when inflated.

9. The method of claim 8 further comprising:

repositioning the service media beneath the printheads;

inflating the service media so that the absorbent material of the service media contacts the nozzle surface of the printheads, wherein the service media is held stationary when inflated; and deflating the service media.

10. The method of claim 8 further comprising:

removing the service media from beneath the printheads.

11. The method of claim 10 further comprising replacing the absorbent material on the service media.

12. The method of claim 8 wherein inserting the service media comprises:

inserting the service media in a gap between the printheads and a web of print media.

13. The method of claim 8 wherein:

the service media includes an inflatable bladder; and inflating the service media comprises injecting a fluid into the inflatable bladder.

14. A cleaning apparatus for one or more printheads, the cleaning apparatus comprising:

a service media configured for insertion beneath the one or more printheads, the service media comprising:

a backing member;

an absorbent material; and an inflatable bladder disposed between the backing member and the absorbent material.

15. The cleaning apparatus of claim 14, wherein the service media further comprises:

an adhesive that adheres the absorbent material to the backing member.

16. The cleaning apparatus of claim 14, wherein:

the absorbent material defines a contact area that is at least as large as a footprint of the one or more printheads.

17. The cleaning apparatus of claim 14 wherein:

the absorbent material comprises a non-woven fabric.

18. The cleaning apparatus of claim 14 wherein:

the absorbent material comprises an absorbent coating applied to the inflatable bladder.

19. The cleaning apparatus of claim 14 wherein:

the inflatable bladder includes a port configured to receive a fluid from a pressure source.

20. The cleaning apparatus of claim 14 wherein:

the service media includes a plurality of inflatable bladders that are independently inflatable.

* * * * *